US009114061B1

(12) United States Patent
Wooten-Sims

(10) Patent No.: US 9,114,061 B1
(45) Date of Patent: Aug. 25, 2015

(54) LIQUID MEDICATION REMINDER ASSEMBLY

(71) Applicant: Burma Wooten-Sims, West Covina, CA (US)

(72) Inventor: Burma Wooten-Sims, West Covina, CA (US)

( * ) Notice: Subject to any disclaimer, the term of this patent is extended or adjusted under 35 U.S.C. 154(b) by 184 days.

(21) Appl. No.: 13/895,541

(22) Filed: May 16, 2013

(51) Int. Cl.
*B65D 83/04* (2006.01)
*A61J 7/04* (2006.01)
*A61J 1/00* (2006.01)

(52) U.S. Cl.
CPC .... *A61J 1/00* (2013.01); *A61J 7/04* (2013.01); *B65D 2583/0409* (2013.01)

(58) Field of Classification Search
CPC ..... A61J 7/04; B65D 2583/0409
USPC ..... 206/459.1, 459.5, 528, 534, 540; 116/308, 309, 315–318; 215/228, 230
See application file for complete search history.

(56) References Cited

U.S. PATENT DOCUMENTS 2,767,680 A * 10/1956 Lermer ..... 116/308
4,528,933 A * 7/1985 Allen ..... 116/308
4,877,119 A * 10/1989 Hosking ..... 206/459.1
4,920,912 A * 5/1990 Kirkling ..... 116/308
4,951,596 A * 8/1990 Wallace, Jr. ..... 116/321
5,356,012 A * 10/1994 Tang et al. ..... 206/534
5,433,343 A 7/1995 Meshberg
5,645,534 A 7/1997 Chanoch
5,823,346 A * 10/1998 Weiner ..... 206/534
5,979,698 A * 11/1999 Deal ..... 116/308
6,089,180 A * 7/2000 Nichols, Jr. ..... 116/309
D462,760 S 9/2002 Ahlgrim et al.
6,792,939 B1 9/2004 Weinstein
7,857,134 B2 * 12/2010 Koch ..... 206/534
8,020,507 B2 9/2011 Strong
8,021,342 B2 9/2011 Girgis et al.
8,136,687 B2 * 3/2012 Wu ..... 215/230
2008/0011703 A1 * 1/2008 Schmeisser et al. ..... 215/230
2009/0114143 A1 5/2009 Shih
2011/0284415 A1 * 11/2011 Balakier et al. ..... 206/459.1

* cited by examiner

*Primary Examiner* — Luan K Bui

(57) ABSTRACT

A liquid medication reminder assembly stores liquid medication and provides a reminder when to take the medication. The assembly includes a container having a bottom portion and a cap. The bottom portion defines an interior space configured for holding a medication. A top edge of a perimeter wall of the bottom portion defines an opening into the interior space. The cap is coupled to the bottom portion of the container. Each of plurality of indicia is positioned on the container corresponding to a unique time period. A band is coupled to and extends around the container over the indicia. An opening extends through the band. The band is movably coupled to the container wherein the opening is alignable with a selectable one of the indicia on the container such that the selectable one of the indicia is visible through the opening.

11 Claims, 6 Drawing Sheets

LIQUID MEDICATION REMINDER ASSEMBLY

BACKGROUND OF THE DISCLOSURE

Field of the Disclosure

The disclosure relates to reminder devices and more particularly pertains to a new reminder device for storing a liquid medication and providing a reminder when to take the liquid medication.

SUMMARY OF THE DISCLOSURE

An embodiment of the disclosure meets the needs presented above by generally comprising a container having a bottom portion and a cap. The bottom portion defines an interior space configured for holding a medication. A top edge of a perimeter wall of the bottom portion defines an opening into the interior space. The cap is coupled to the bottom portion of the container. Each of plurality of indicia is positioned on the container corresponding to a unique time period. A band is coupled to and extends around the container over the indicia. An opening extends through the band. The band is movably coupled to the container wherein the opening is alignable with a selectable one of the indicia on the container such that the selectable one of the indicia is visible through the opening.

There has thus been outlined, rather broadly, the more important features of the disclosure in order that the detailed description thereof that follows may be better understood, and in order that the present contribution to the art may be better appreciated.

There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
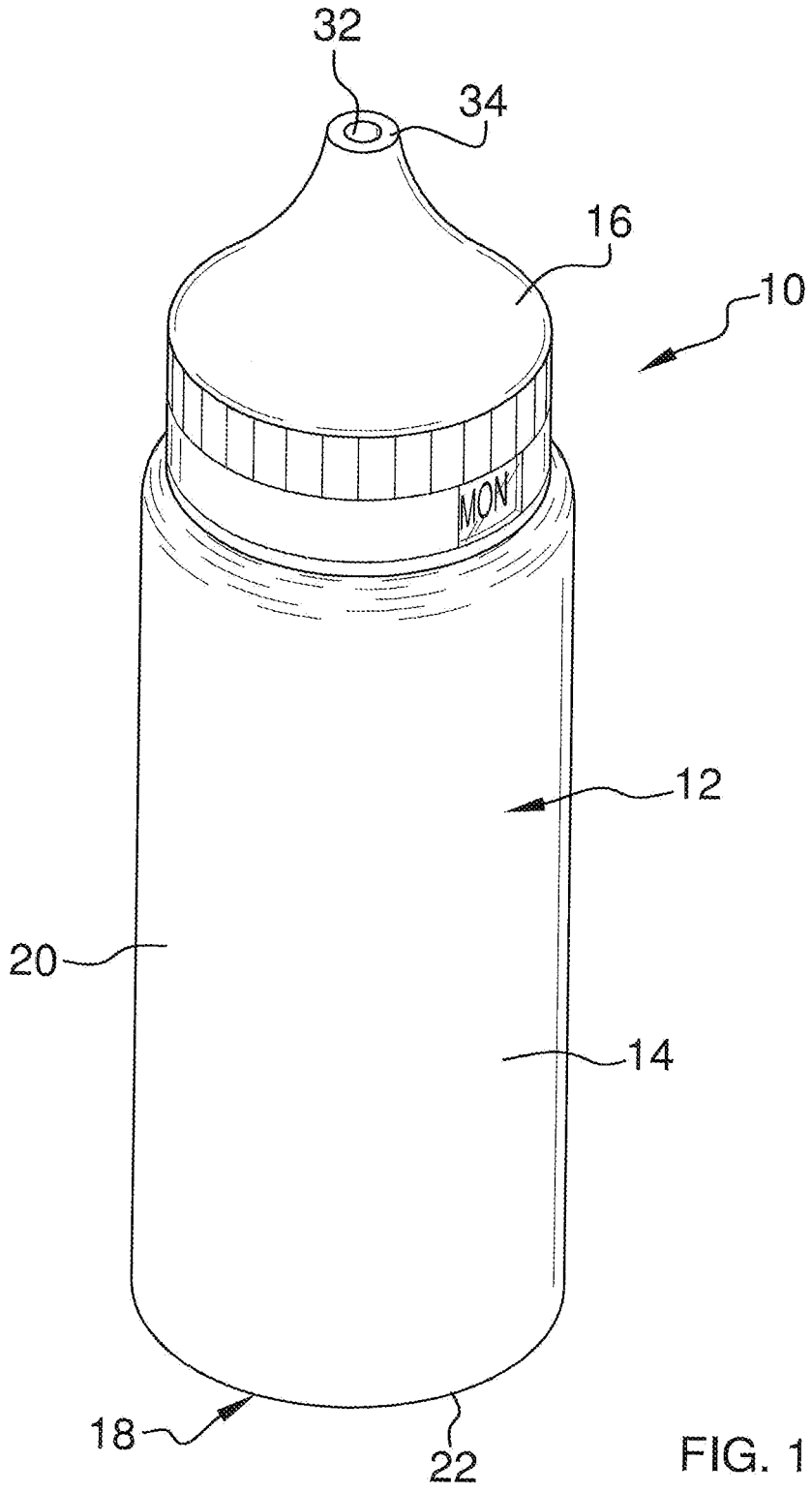
FIG. 1 is a top front side perspective view of a liquid medication reminder assembly according to an embodiment of the disclosure.
Figure 2:
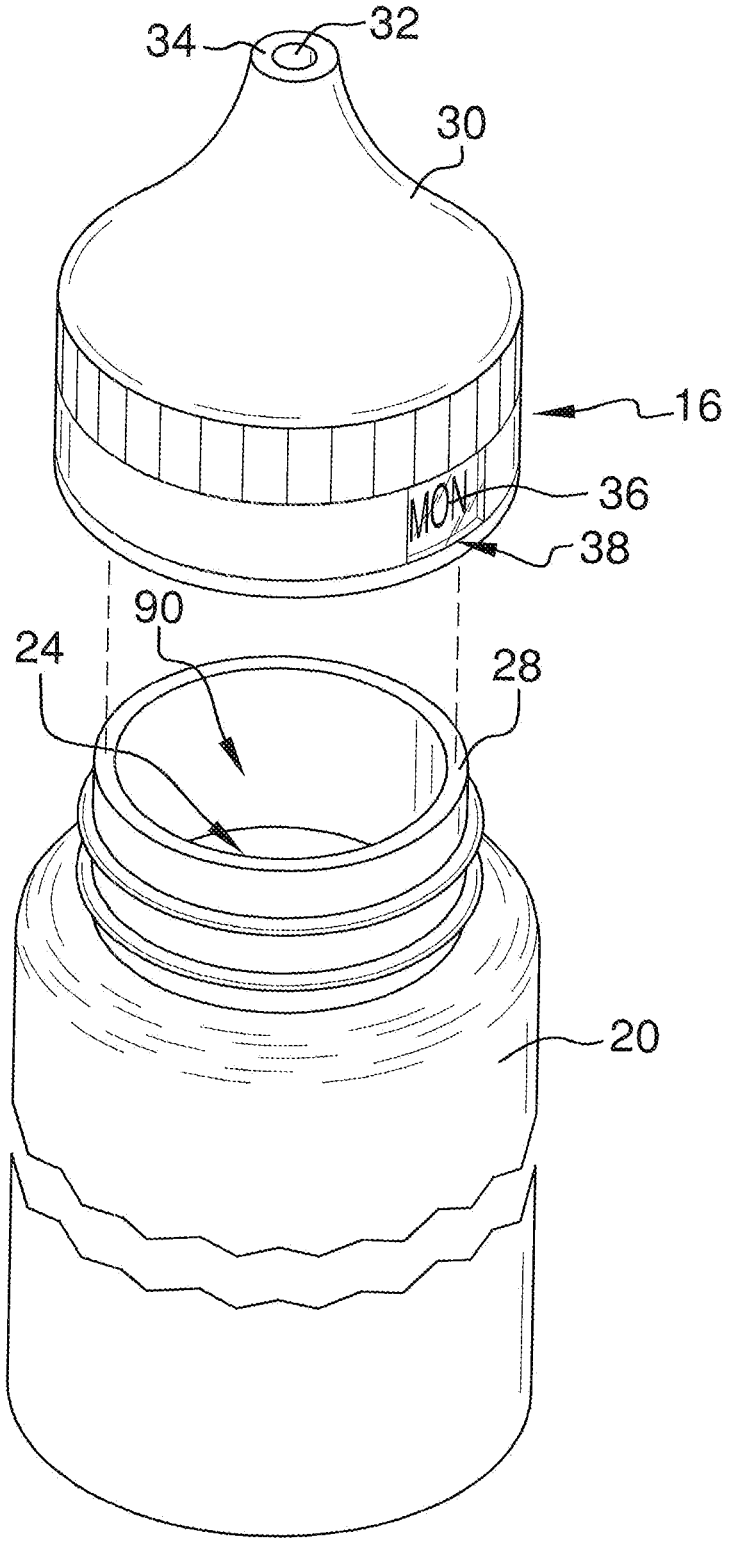
FIG. 2 is a partially exploded top front side perspective view of an embodiment of the disclosure.
Figure 3:
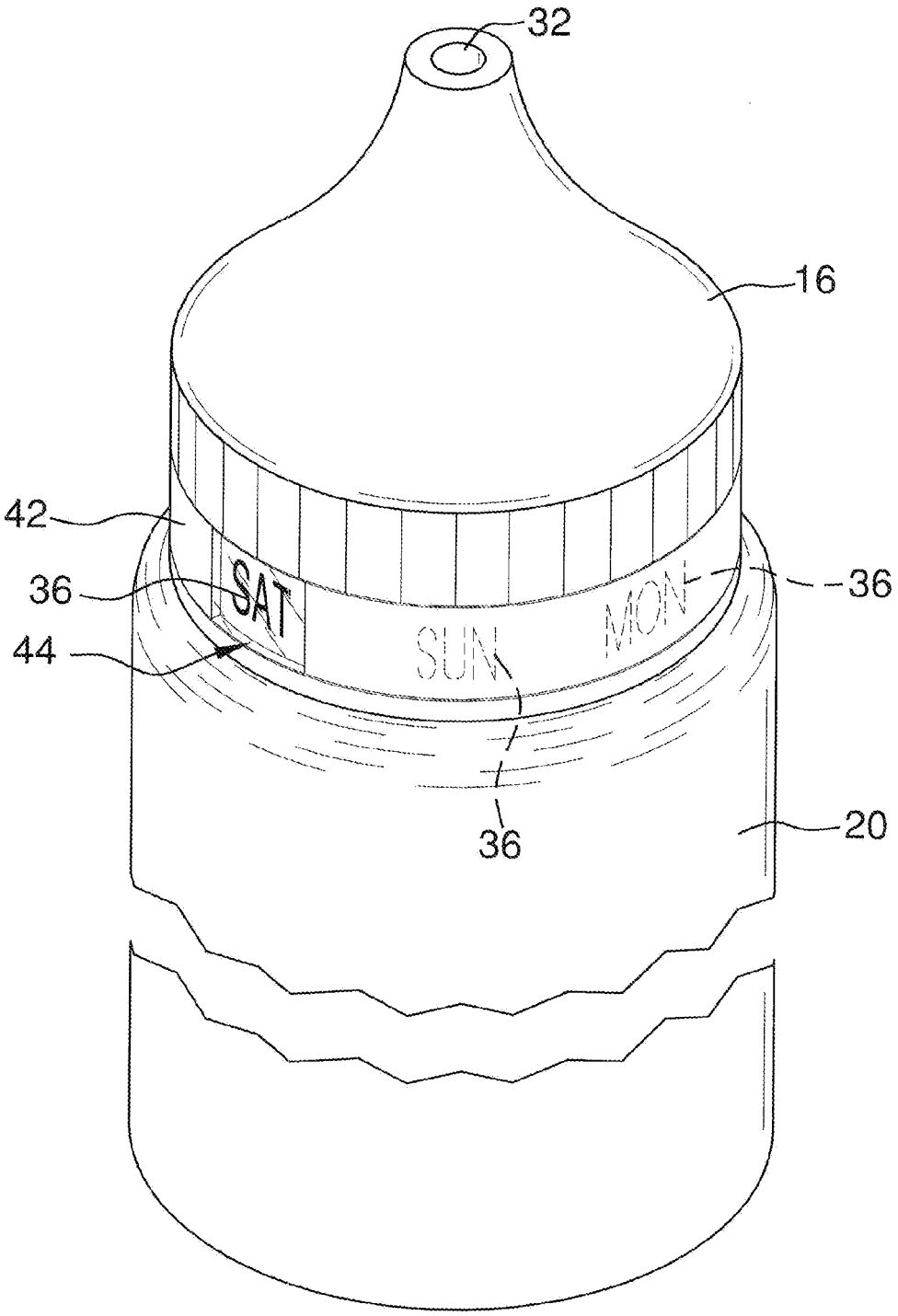
FIG. 3 is a top back side perspective view of an embodiment of the disclosure.
Figure 4:
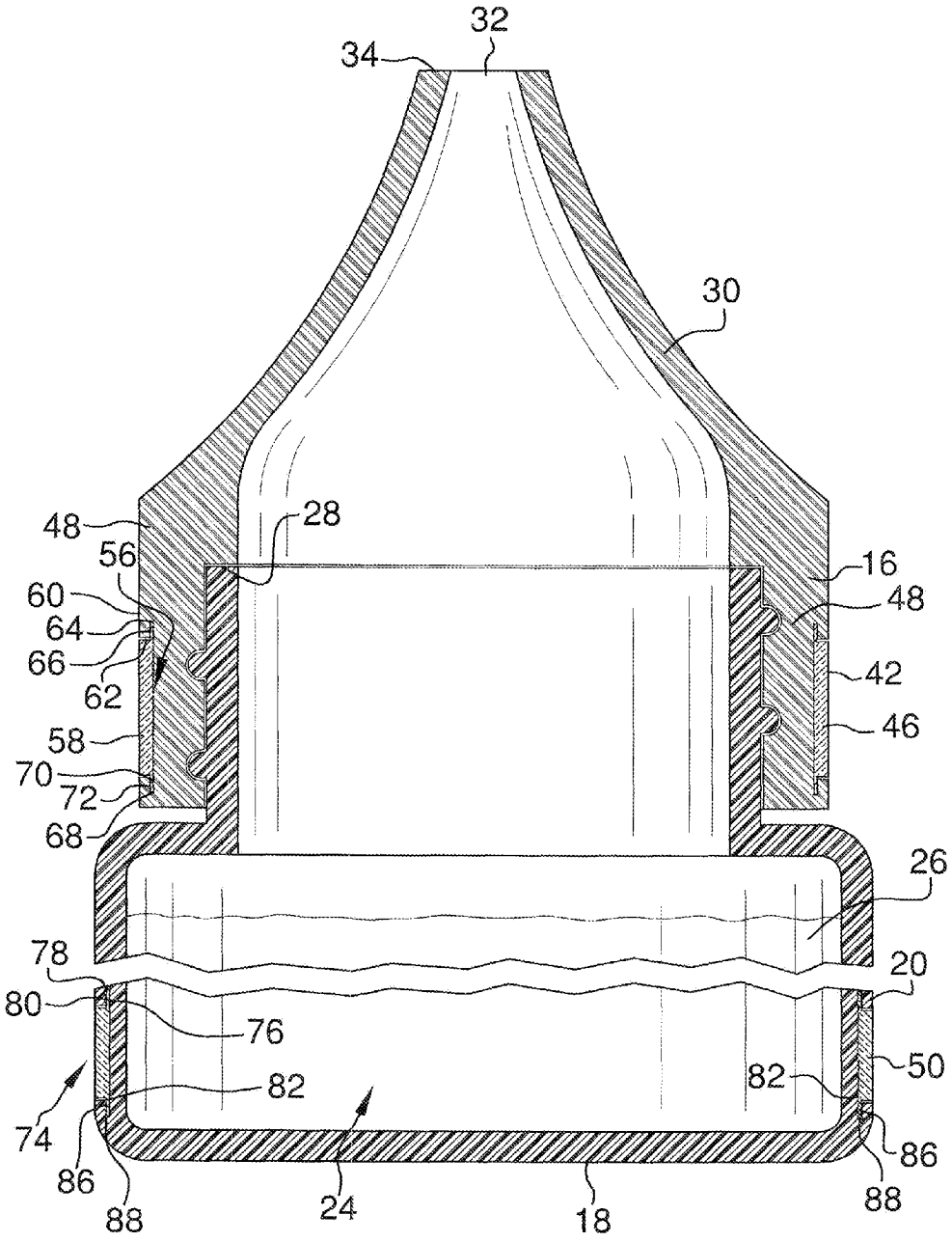
FIG. 4 is a cross-sectional view of an embodiment of the disclosure taken along line 4-4 of FIG. 6.
Figure 5:
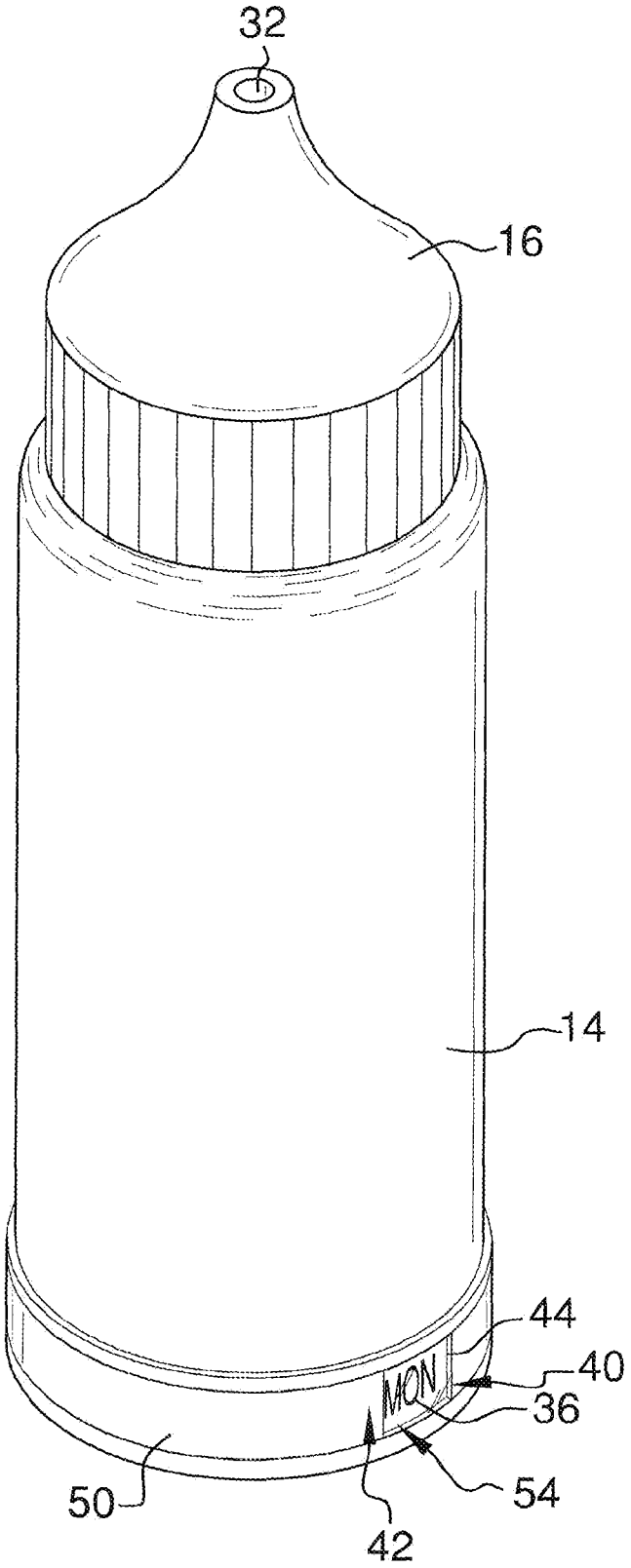
FIG. 5 is a top front side perspective view of an alternative embodiment of the disclosure.
Figure 6:
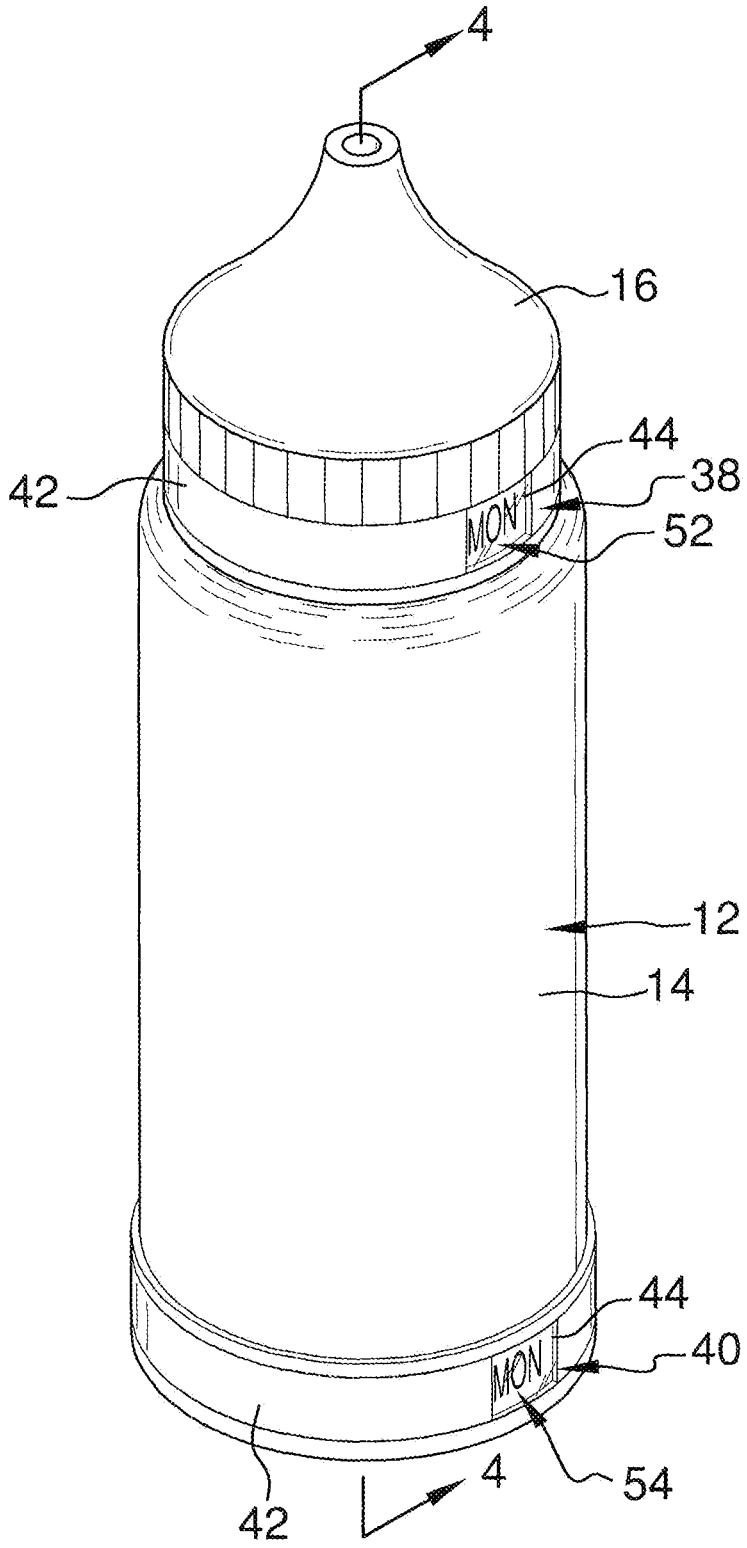
FIG. 6 is a top front side perspective view of an alternative embodiment of the disclosure.

With reference now to the drawings, and in particular to FIGS. 1 through 6 thereof, a new reminder device embodying the principles and concepts of an embodiment of the disclosure and generally designated by the reference numeral 10 will be described.

As best illustrated in FIGS. 1 through 6, the liquid medication reminder assembly 10 generally comprises a container 12 having a bottom portion 14 and a cap 16. The bottom portion 14 has a bottom wall 18 and a perimeter wall 20 coupled to and extending from a perimeter edge 22 of the bottom wall 18 defining an interior space 24 configured for holding a medication 26. The medication 26 may be a liquid. A top edge 28 of the perimeter wall 20 defining an opening 90 into the interior space 24. The cap 16 is coupled to the bottom portion 14 of the container 12. A top portion 30 of the cap 16 may be tapered extending away from the container 14. An aperture 32 may extend through the cap 16 at an apex 34 of the top portion 30 of the cap 16.

A plurality of indicia 36 is positioned on the container 12. The indicia 36 may be integrally incorporated into the container 12 or may be provided on a ring or the like attached to the container 12. Each indicia 36 corresponds to a time period such as a day of the week, hour of the day, or the like. The indicia 36 may be arranged into a first set 38 of indicia 36 positioned on the cap 16 and a second set 40 of indicia 36 positioned on the bottom portion 14 of the container 12. Each of the indicia 36 within the first set 38 of indicia 36 and the second set 40 of indicia 36 may correspond to a unique day of the week. Thus, the first set 38 and second set 40 may be used to indicate both a morning and an afternoon for the same day of the week if two sets of indicia 36 are provided.

At least one band 42 having an opening 44 therethrough is provided. When two sets of indicia 36 are provided, an upper band 46 is coupled to and extends around the container 12 over the first set 38 of indicia 36. The upper band 46 is coupled to and extends around a peripheral wall 48 of the cap 16. A lower band 50 is coupled to and extends around the container 12 over the second set 40 of indicia 36. The lower band 50 is coupled to and extends around the perimeter wall 20 of the bottom portion 14 of the container 12 proximate the bottom wall 16 of the bottom portion 14 of the container 12.

The opening 44 extends through the upper band 46 and the upper band 46 is movably coupled to the container 12 wherein the opening 44 through the upper band 46 is alignable with a selectable one of the indicia 36 of the first set 38 of indicia 36. Thus, the selectable one of the first set 38 of indicia 36 is visible through the opening 44 through the upper band 46. A magnifying lens 52 may be positioned in the opening 44 through the upper band 46 wherein the lens 52 magnifies the selectable indicia 36 aligned with the opening 44 through the upper band 46, Similarly, the opening 44 extends through the lower band 50 and the lower band 50 is movably coupled to the container 12 wherein the opening 44 through the lower band 50 is alignable with a selectable one of the second set 40 of indicia 36 on the container 12. Thus, the selectable one of the second set 40 of indicia 36 is visible through the opening 44 through the lower band 50. A second magnifying lens 54 may be positioned in the opening 44 through the lower band 50 wherein the lens 54 magnifies the selectable indicia 36 aligned with the opening 44 through the lower band 50.

A main channel 56 may extend into and around the peripheral wall 48 of the cap 16. The upper band 46 is positioned in the main channel 56. An outer face 58 of the upper band 46 may be flush with an outer surface 60 of the peripheral wall 48. An upper channel 62 extends upwardly into the peripheral wall 48 of the cap 16 from the main channel 56 defining an upper groove 64. An upper tab 66 extends from the upper band 46 and is positioned in the upper groove 64. A lower channel 68 may also extend downwardly into the peripheral wall 48 of the cap 16 from the main channel 56 defining a lower groove 70. A lower tab 72 extends from the upper band 46 and is positioned in the lower groove 70.

Similarly, a primary channel 74 may extend into and around the perimeter wall 20 of the bottom portion 14 of the container 12. The lower band 50 is positioned in the primary channel 74. An upper channel 76 may extend upwardly into the perimeter wall 20 of the bottom portion 14 of the container 12 from the primary channel 74 defining a top groove 78. A top tab 80 extends from the lower band 50 and is positioned in the top groove 78. A bottom channel 82 extends downwardly into the perimeter wall 20 of the bottom portion 14 of the container 12 from the primary channel 74 defining a bottom groove 86. A bottom tab 88 extends from the lower band 50 and is positioned in the bottom groove 86.

In use, the assembly 10 may provide single or dual displays of a time label shown by the indicia 36 displayed through the opening or openings 44, A user may use the indicia 36 to indicate a time the last medication 26 was taken or the time when the next medication 26 is to be taken. Utilizing the upper band 46 and lower band 50 the user may track for two unique times for medication 26 on each day by designating the upper band 46 for morning and the lower band 50 for afternoon or vice versa.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A liquid medication reminder assembly comprising:

a container having a bottom portion and a cap, said bottom portion having a bottom wall and a perimeter wall coupled to and extending from a perimeter edge of said bottom wall defining an interior space configured for holding a medication, a top edge of said perimeter wall defining an opening into said interior space, said cap being coupled to said bottom portion of said container; a primary channel extending into and around said perimeter wall of said bottom portion of said container;

a plurality of indicia positioned on said container, each said indicia corresponding to a unique time period;

a band coupled to and extending around said container over said indicia, said band being coupled to and extending around said perimeter wall of said bottom portion of said container proximate said bottom wall of said bottom portion of said container, said band being positioned in said primary channel;

an opening extending through said band, said band being movably coupled to said container wherein said opening is alignable with a selectable one of said indicia on said container wherein said selectable one of said indicia is visible through said opening;

a magnifying lens positioned in said opening wherein said lens magnifies said selectable indicia aligned with said opening;

a top portion of said cap being tapered extending away from said container; and an aperture extending through said cap at an apex of said top portion of said cap.

2. The assembly of claim 1, further comprising said band being coupled to and extending around a peripheral wall of said cap.

3. The assembly of claim 1, further comprising each of said indicia corresponding to a unique day of the week.

4. The assembly of claim 2, further comprising a main channel extending into and around said peripheral wall of said cap, said band being positioned in said main channel.

5. The assembly of claim 4, further comprising:

an upper channel extending upwardly into said peripheral wall of said cap from said main channel defining an upper groove; and an upper tab extending from said band, said upper tab being positioned in said upper groove.

6. The assembly of claim 5, further comprising:

a lower channel extending downwardly into said peripheral wall of said cap from said main channel defining an lower groove; and a lower tab extending from said band, said lower tab being positioned in said lower groove.

7. The assembly of claim 4, further comprising:

an upper channel extending upwardly into said peripheral wall of said cap from said main channel defining an upper groove;

an upper tab extending from said band, said upper tab being positioned in said upper groove;

a lower channel extending downwardly into said peripheral wall of said cap from said main channel defining an lower groove; and a lower tab extending from said band, said lower tab being positioned in said lower groove.

8. The assembly of claim 1, further comprising:

a upper channel extending upwardly into said perimeter wall of said bottom portion of said container from said primary channel defining a top groove; and a top tab extending from said band, said top tab being positioned in said top groove.

9. The assembly of claim 1, further comprising:

a bottom channel extending downwardly into said perimeter wall of said bottom portion of said container from said primary channel defining a bottom groove; and a bottom tab extending from said band, said bottom tab being positioned in said bottom groove.

10. The assembly of claim 1, further comprising:

a upper channel extending upwardly into said perimeter wall of said bottom portion of said container from said primary channel defining a top groove;

a top tab extending from said band, said top tab being positioned in said top groove;

a bottom channel extending downwardly into said perimeter wall of said bottom portion of said container from said primary channel defining a bottom groove; and a bottom tab extending from said band, said bottom tab being positioned in said bottom groove.

11. A liquid medication reminder assembly comprising:

a container having a bottom portion and a cap, said bottom portion having a bottom wall and a perimeter wall coupled to and extending from a perimeter edge of said bottom wall defining an interior space configured for holding a medication, a top edge of said perimeter wall defining an opening into said interior space, said cap being coupled to said bottom portion of said container;

a top portion of said cap being tapered extending away from said container;

an aperture extending through said cap at an apex of said top portion of said cap;

a plurality of indicia positioned on said container, each said indicia corresponding to a time period, said indicia being arranged into a first set of upper indicia positioned on said cap and a second set of indicia positioned on said bottom portion of said container, each of said indicia within said first set of indicia and said second set of indicia corresponding to a unique day of the week;

an upper band coupled to and extending around said container over said first set of indicia, said upper band being coupled to and extending around a peripheral wall of said cap;

a lower band coupled to and extending around said container over said second set of indicia, said lower band being coupled to and extending around said perimeter wall of said bottom portion of said container proximate said bottom wall of said bottom portion of said container;

an opening extending through said upper band, said upper band being movably coupled to said container wherein said opening through said upper band is alignable with a selectable one of said indicia of said first set of indicia on said container wherein said selectable one of said first set of indicia is visible through said opening through said upper band;

a magnifying lens being positioned in said opening through said upper band wherein said lens magnifies said selectable indicia aligned with said opening through said upper band;

an opening extending through said lower band, said lower band being movably coupled to said container wherein said opening through said lower band is alignable with a selectable one of said second set of indicia on said container wherein said selectable one of said second set of indicia is visible through said opening through said lower band;

a magnifying lens being positioned in said opening through said lower band wherein said lens magnifies said selectable indicia aligned with said opening through said lower band;

a main channel extending into and around said peripheral wall of said cap, said upper band being positioned in said main channel;

an upper channel extending upwardly into said peripheral wall of said cap from said main channel defining an upper groove;

an upper tab extending from said upper band, said upper tab being positioned in said upper groove;

a lower channel extending downwardly into said peripheral wall of said cap from said main channel defining a lower groove;

a lower tab extending from said upper band, said lower tab being positioned in said lower groove;

a primary channel extending into and around said perimeter wall of said bottom portion of said container, said lower band being positioned in said primary channel;

a upper channel extending upwardly into said perimeter wall of said bottom portion of said container from said primary channel defining a top groove;

a top tab extending from said lower band, said top tab being positioned in said top groove;

a bottom channel extending downwardly into said perimeter wall of said bottom portion of said container from said primary channel defining a bottom groove;

a bottom tab extending from said lower band, said bottom tab being positioned in said bottom groove.

* * * * *